US007907003B2

(12) United States Patent
Pulijala et al.

(10) Patent No.: US 7,907,003 B2
(45) Date of Patent: Mar. 15, 2011

(54) METHOD FOR IMPROVING POWER-SUPPLY REJECTION

(75) Inventors: Srinivas K. Pulijala, Tucson, AZ (US); Paul F. Illegems, Tucson, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 0 days.

(21) Appl. No.: 12/353,843

(22) Filed: Jan. 14, 2009

(65) Prior Publication Data

US 2010/0176875 A1 Jul. 15, 2010

(51) Int. Cl.
*G05F 1/10* (2006.01)
*G05F 3/02* (2006.01)

(52) U.S. Cl. ..... 327/541; 327/538; 327/540; 323/313; 323/314

(58) Field of Classification Search ..... 327/530, 327/538–543, 546; 323/312–317
See application file for complete search history.

(56) References Cited

U.S. PATENT DOCUMENTS

| | | | |
|---|---|---|---|
| 3,980,935 | A | 9/1976 | Worst |
| 4,442,529 | A | 4/1984 | Ahuja et al. |
| 4,611,289 | A | 9/1986 | Coppola |
| 4,851,987 | A | 7/1989 | Day |
| 5,222,239 | A | 6/1993 | Rosch |
| 5,230,074 | A | 7/1993 | Canova, Jr. et al. |
| 5,278,523 | A | 1/1994 | Kriz |
| 5,283,792 | A | 2/1994 | Davies, Jr. et al. |
| 5,300,874 | A | 4/1994 | Shimamoto et al. |
| 5,339,446 | A | 8/1994 | Yamasaki et al. |
| 5,341,112 | A | 8/1994 | Haman |
| 5,369,771 | A | 11/1994 | Gettel |
| 5,386,201 | A | 1/1995 | Bennett et al. |
| 5,386,552 | A | 1/1995 | Garney |
| 5,410,713 | A | 4/1995 | White et al. |
| 5,423,045 | A | 6/1995 | Kannan et al. |

(Continued)

FOREIGN PATENT DOCUMENTS

EP 0187369 7/1986

(Continued)

OTHER PUBLICATIONS

Sedra, Adel, and Kenneth Smith. Microelectronic Circuits. 4th Edition. New York: Oxford University Press, 1998. 4 pages.

(Continued)

*Primary Examiner* — Lincoln Donovan
*Assistant Examiner* — Brandon S Cole
(74) *Attorney, Agent, or Firm* — Meyertons Hood Kivlin Kowert & Goetzel, P.C.; Jeffrey C. Hood

(57) ABSTRACT

An electronic circuit may comprise an input stage powered by a supply voltage and configured to receive a reference signal. The circuit may further comprise an output stage powered by the supply voltage and coupled to the input stage, and configured to generate an error signal based on: the reference signal, and a feedback signal based on an output signal. The circuit may also include a pass transistor powered by the supply voltage and configured to generate the output signal based on the error signal. A capacitor coupled between the supply voltage and the output stage may increase the current flowing in the output stage, resulting in the output stage conducting current even during a rising edge of the supply voltage, preventing the output signal from reaching the level of the supply voltage during the rising edge of the supply voltage.

20 Claims, 3 Drawing Sheets

U.S. PATENT DOCUMENTS 5,440,277 A 8/1995 Ewen et al.
5,450,003 A 9/1995 Cheon
5,581,772 A 12/1996 Nanno et al.
5,638,540 A 6/1997 Aldous
5,691,663 A 11/1997 Nayebi et al.
5,717,560 A 2/1998 Doyle et al.
5,764,110 A 6/1998 Ishibashi
5,907,464 A 5/1999 Maloney et al.
5,936,460 A 8/1999 Iravani
5,936,478 A 8/1999 Lee et al.
5,945,883 A 8/1999 Nagasawa et al.
5,956,219 A 9/1999 Maloney
6,008,970 A 12/1999 Maloney et al.
6,066,991 A 5/2000 Natio et al.
6,118,266 A 9/2000 Manohar et al.
6,194,917 B1 2/2001 Deng
6,268,993 B1 7/2001 Anderson
6,271,652 B1 8/2001 Burstein et al.
6,292,050 B1 9/2001 Dooley et al.
6,377,130 B1 4/2002 Haman
6,433,621 B1 8/2002 Smith et al.
6,462,625 B2 10/2002 Kim
6,492,796 B1 12/2002 Morley
6,522,208 B1 2/2003 Knowles
6,541,946 B1 4/2003 Chen et al.
6,560,081 B1 5/2003 Vashchenko et al.
6,577,481 B2 6/2003 Steinhoff et al.
6,690,555 B1 2/2004 Pasqualini
6,744,610 B2 6/2004 Chang et al.
6,747,501 B2 6/2004 Ker et al.
6,750,684 B2 * 6/2004 Lim ..... 327/108
6,760,209 B1 7/2004 Sharpe-Geisler
6,768,176 B1 7/2004 Litfin
6,771,117 B2 8/2004 Nakai
6,775,217 B1 8/2004 Kato et al.
6,788,507 B2 9/2004 Chen et al.
6,800,906 B2 10/2004 Cheng
6,809,557 B2 10/2004 Gauthier et al.
6,809,603 B1 10/2004 Ho
6,829,126 B2 12/2004 Lee et al.
6,838,775 B2 1/2005 Takahashi
6,844,595 B2 1/2005 Chen
6,853,258 B2 2/2005 Toliver et al.
6,864,536 B2 3/2005 Lin et al.
6,876,529 B2 4/2005 Li
6,897,637 B2 5/2005 Chen et al.
6,930,534 B1 8/2005 Fu
6,985,040 B2 1/2006 Kim
6,992,533 B2 1/2006 Hollinger et al.
7,076,229 B2 7/2006 Wang
7,129,798 B2 10/2006 Aoyama et al.
7,132,880 B2 11/2006 Ingino, Jr.
7,164,325 B2 1/2007 Aparin et al.
7,180,331 B2 2/2007 Gosmain et al.
7,230,806 B2 6/2007 Poon et al.
7,248,025 B2 7/2007 Adachi
7,342,465 B2 3/2008 Seefeldt
7,358,780 B2 4/2008 Chou
7,501,867 B2 3/2009 Poulton et al.
7,554,307 B2 6/2009 Moraveji
7,573,322 B2 8/2009 Gatta et al.
7,656,145 B2 2/2010 Xiao et al.
7,688,051 B1 3/2010 Li et al.
2004/0251980 A1 12/2004 Hollinger et al.
2006/0232326 A1 10/2006 Seitz et al.
2007/0036017 A1 2/2007 Seo
2007/0210857 A1 * 9/2007 Wu et al. ..... 327/541
2007/0273453 A1 11/2007 Maher
2007/0290660 A1 * 12/2007 Yamazaki ..... 323/222
2008/0084249 A1 4/2008 Noguchi

FOREIGN PATENT DOCUMENTS

EP 0547862 6/1993
WO 9006552 6/1990

OTHER PUBLICATIONS

Timothy J. Maloney, Steven S. Poon, and Lawrence T. Clark, "Methods for Designing Low-leakage Power Supply Clamps," 2003, EOS/ESD Symposium, 7 pages.

* cited by examiner

METHOD FOR IMPROVING POWER-SUPPLY REJECTION

BACKGROUND OF THE INVENTION

1. Field of the Invention

This invention relates generally to the field of semiconductor circuit design, and more particularly to the design of improved power regulators.

2. Description of the Related Art

Many electronic power supplies feature voltage regulators, or regulator circuits, designed to automatically maintain a constant output voltage level to effectively provide a steady voltage to the electronic circuit to which power is being supplied, typically referred to as the load. More particularly, the object of a voltage regulator circuit is to maintain a steady output voltage regardless of current drawn by the load. Most present day voltage regulators operate by comparing the actual output voltage to a fixed—typically internal—reference voltage. The difference between the actual output voltage and reference voltage is amplified, and used for controlling a regulation element, to form a negative feedback servo control loop. The regulation element is typically configured to produce a higher voltage when the output voltage is too low, and in case of some regulators, to produce a lower voltage when the output voltage is too high. In many cases, the regulation element may be configured to simply stop sourcing current, and depend on the current drawn by the driven load to pull down the regulator output voltage. The control loop has to be carefully designed to produce the desired tradeoff between stability and speed of response.

The operation of power supplies is typically affected by variations on the input voltage (or power supply) line that provides the voltage based on which the regulated output voltage is generated. Any signal or noise (including transients, which may reach very high levels relative to the level of the desired output voltage) on the supply line may couple into, and may be amplified by the active circuitry, thereby degrading the performance of the power supply. Therefore, in addition to design considerations related to stability and speed of response, power supplies are also typically designed to achieve a desired power supply rejection ratio (PSRR), which is indicative of the amount of noise (on the supply line) that the power regulator is capable of rejecting. Various systems may specify different power supply rejection requirements. For example, an internal power regulator using a 25 pF output capacitor in an automotive environment may experience power supply variations that range from 5V to 26V and may include transient spikes as high as 40V. Thus, any power supply or regulator designed to properly function in such an environment would need to be designed to reject all such variations and transients.

Therefore, one measure of the effectiveness of a voltage regulator circuit is its ability to respond to system transients. For example, if the load coupled to a voltage regulator is an integrated circuit (IC) in which a large number of drivers may switch states simultaneously, the demand for current from the voltage regulator may change suddenly. An ideal voltage regulator is able to meet the demand for increased current while maintaining its designed output voltage $V_{out}$. However, this may not always be practical for a given voltage regulator circuit and a given load. In practice, a load capacitance (coupled between the voltage output node and ground) is typically provided in order to meet the immediate demand for increased current. Typical solutions for increasing power supply rejection include use of a large load capacitor, and/or use of a pass transistor coupled at the output.

In addition, in some situations, a circuit used to implement a voltage regulator may be subject to short circuit or overload conditions for a significant amount of time. In such cases, the circuit may become damaged without protection against excessive currents that may result from such conditions. Similarly, other types of circuits (e.g., amplifiers) may also be susceptible to problems similar to those discussed above with regard to voltage regulators. Many other problems and disadvantages of the prior art will become apparent to one skilled in the art after comparing such prior art with the present invention as described herein.

SUMMARY OF THE INVENTION

In one set of embodiments, a voltage regulator may comprise a regulator output configured to provide a regulated voltage, built around an error amplifier powered by a supply voltage and having a first input configured to receive a reference signal. The voltage regulator may include a pass transistor having a control terminal coupled to an output of the error amplifier, and a channel coupled between the supply voltage and the regulator output. A control loop may be formed by coupling the regulator output to a second input of the error amplifier, which may comprise an output stage configured to provide the output signal of the error amplifier. In one embodiment, the error amplifier may be configured to control its output stage to conduct current during a rising edge of the supply voltage to prevent the regulated output voltage from rising during the rising edge of the supply voltage.

The voltage regulator output may be configured with a voltage divider, which may include a first resistor coupled between the second input of the error amplifier and the regulator output, and a second resistor coupled between the regulator output and a voltage reference, which may be reference ground. In one set of embodiments, the error amplifier may comprise a first input transistor having a first channel terminal configured to draw a first portion of a first current generated from the supply voltage, and a control terminal configured as the first input of the error amplifier. The error amplifier may further have a second input transistor with a first channel terminal configured to draw a second portion of the first current, and a control terminal configured as the second input of the error amplifier. The first and second input transistors may constitute an input stage of the error amplifier, and may be coupled to the output stage of the error amplifier.

In one set of embodiments, the output stage of the error amplifier may include four output transistors, and a current mirror configured to provide current to the four transistors. The first output transistor may have a first channel terminal coupled to the regulator output and configured to draw a second current generated from the supply voltage, a second channel terminal coupled to a second channel terminal of the first input transistor, and a control terminal configured to receive a biasing signal. The second output transistor may have a first channel terminal configured to draw a third current generated from the supply voltage, a second channel terminal coupled to a second channel terminal of the second input transistor, and a control terminal configured to receive the biasing signal. The third output transistor may be configured with a first channel terminal coupled to the second channel terminal of the first output transistor, a second channel terminal coupled to a voltage reference (which may be reference ground), and a control terminal coupled to a control node. Finally, the fourth output transistor may have a first channel terminal coupled to the second channel terminal of the second output transistor, a second channel terminal coupled to the voltage reference, and a control terminal coupled to the control node. A capacitor may be coupled between the control node and the regulator output to achieve frequency compensation. In one embodiment, a capacitor may be configured between the supply voltage and the control terminals of the third and fourth transistors to effect additional current to flow through the respective channels of the third and fourth output transistors, to prevent the first and second output transistors from turning off during a rising edge of the supply voltage.

A method of operating an electronic circuit may include providing a supply voltage to the electronic circuit, providing a reference signal to the electronic circuit, generating an output signal based on the supply voltage, the reference signal, and an error signal, and generating a feedback signal based on the output signal, with an output stage of the electronic circuit generating the error signal based on the supply voltage, the reference signal, and the feedback signal. The output stage may be controlled from within the electronic circuit to have the output stage continue to conduct current during a rising edge of the supply voltage to prevent the output signal from rising to the level of the supply voltage during the rising edge of the supply voltage. In one embodiment, controlling the output stage may include preventing a pair of cascode transistors configured in the output stage from turning off during the rising edge of the supply voltage, by causing an additional current to flow through a pair of output transistors having their respective channels coupled between respective channel terminals of the pair of cascode transistors and a voltage reference.

Various embodiments of a regulator circuit may therefore provide improved power supply rejection for very large, fast steps on the voltage supply rail, without a need for any external components, and only requiring very few additional internal components (e.g. a 1 pF capacitor). The voltage regulators may be implemented with a topology that includes a PMOS pass device, while still providing very good rejection of power supply variations, and prevent loss of feedback control during large supply transients.

Other aspects of the present invention will become apparent with reference to the drawings and detailed description of the drawings that follow.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
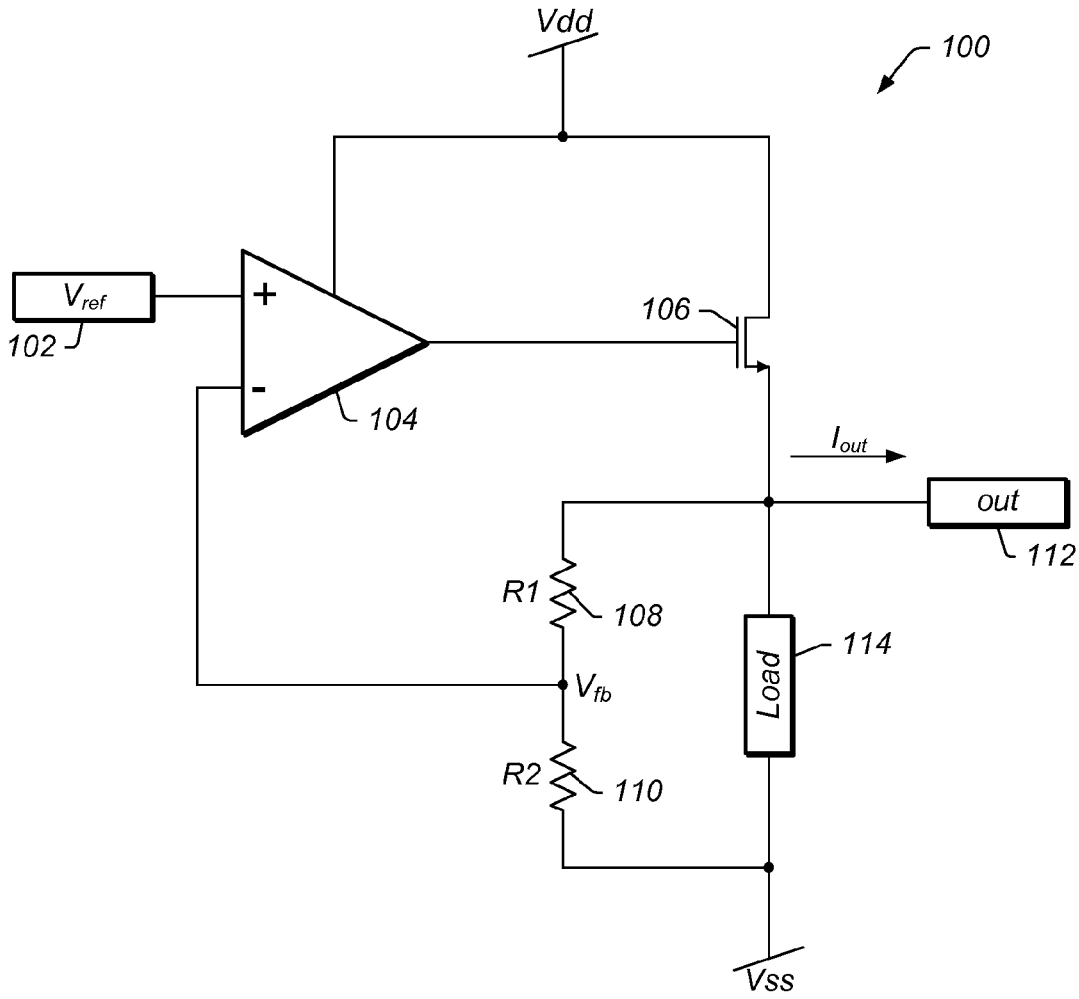
FIG. 1 (PRIOR ART)
FIG. 1 is a schematic diagram of one embodiment of a voltage regulator circuit according to prior art.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "connected" means "directly or indirectly connected", and the term "coupled" means "directly or indirectly connected".

DETAILED DESCRIPTION OF THE PREFERRED EMBODIMENTS

FIG. 1 is a schematic diagram of one embodiment of a voltage regulator circuit 100, according to prior art. In the embodiment shown, an input supply voltage Vdd is provided to operational amplifier 104. The voltage regulator circuit provides an output voltage from the source terminal of transistor 106. Current through transistor 106 and load 114 is controlled via a feedback path between the junction of resistors R1 (108) and R2 (110), which comprise a voltage divider circuit, and the inverting input of operational amplifier 104. The operational amplifier is an error amplifier, used in the circuit to indicate an error between a reference voltage $V_{ref}$ 102, which is provided to the non-inverting terminal of operational amplifier 104, and the voltage present at the junction of R1 (108) and R2 (110), i.e., the feedback voltage, or $V_{fb}$. Operational amplifier 104 is configured to provide an output signal that is proportional to the difference between the reference voltage $V_{ref}$ and the feedback voltage $V_{fb}$, which is used to drive the gate terminal of n-channel transistor 106. This in turn controls the current passing through transistor 106, and thus also controls the current passing through load 114.

Using the circuit shown in FIG. 1 as an example, a load having a suddenly increased demand for current may initially receive current from the load capacitance (which may be included in load 114). However, the load capacitance can only provide a finite amount of current, after which the voltage regulator circuit must provide current for both the load as well as for recharging the load capacitance. When this occurs, the feedback voltage may be pulled down somewhat (assuming discharge of the load capacitance), thereby causing the amplitude of the error signal produced by the error amplifier to increase. This in turn may result in an increased amount of current through transistor 106. Eventually, the increased amount of current will cause both the output 112 and feedback $V_{fb}$ voltages to be pulled up through the voltage divider network.

As mentioned above, power regulators are oftentimes required in an automotive environment, where an internal regulator may be configured with a 25 pF capacitor at the output, and may be required to reject power supply variations (on the power/voltage supply rail) that range from 5V to 26V, while also rejecting transient spikes, which may reach voltage levels as high as 40V. Referring to voltage regulator 100 in FIG. 1, when voltage regulator 100 is configured on an integrated circuit (IC), and is used to power up internal blocks configured on the IC, the IC may not have external pins available to use a large load capacitor to increase the power supply rejection. In addition, the threshold voltage variation with the current load at low power supplies (i.e. when the supply voltage is low) may make the use of an NMOS pass transistor (such as transistor 106) not possible, as there may be no headroom for the $V_{GS}$ (gate-source voltage) of an NMOS pass transistor.

Figure 2:
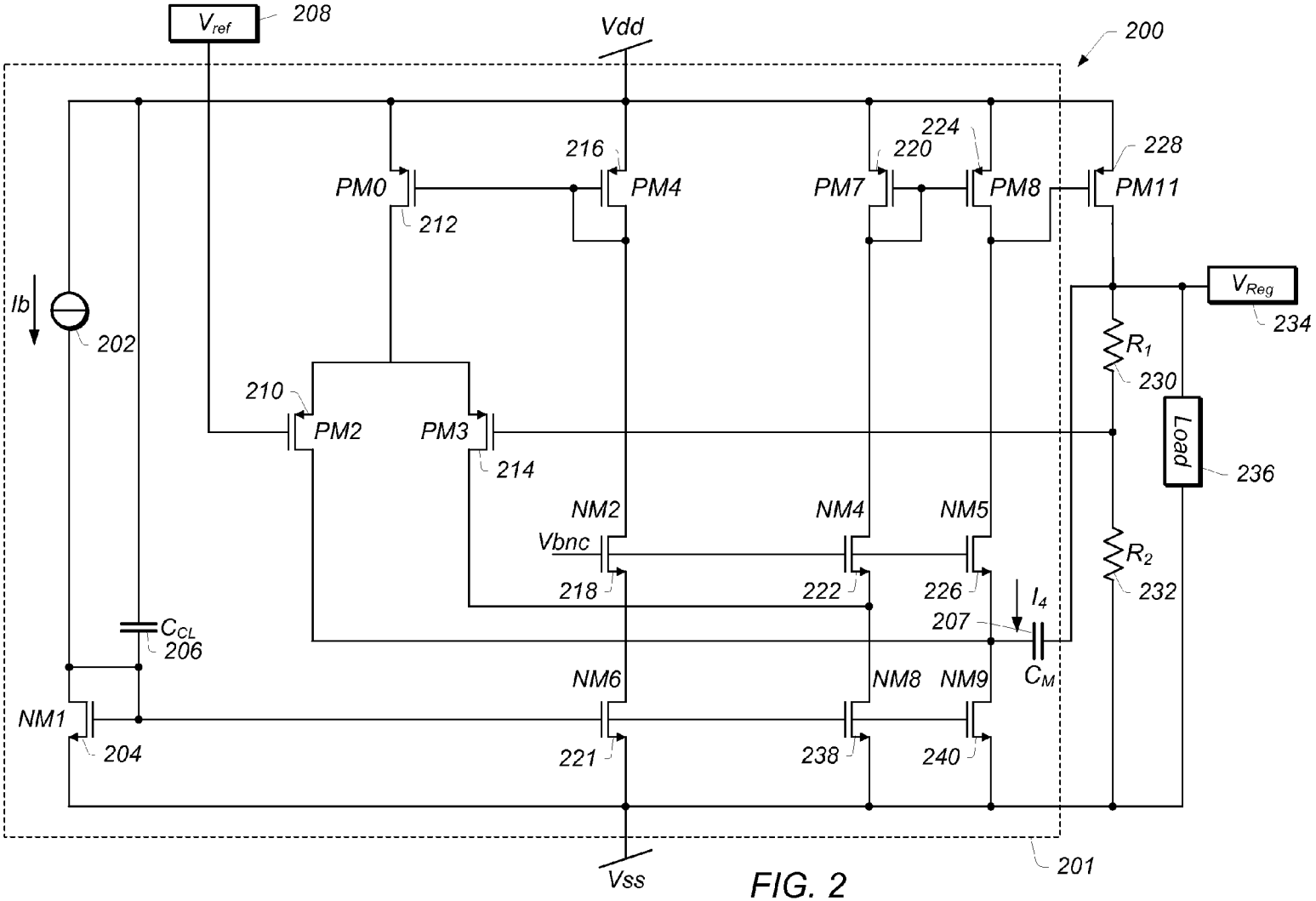
FIG. 2 is a transistor diagram of one embodiment of a voltage regulator circuit configured according to principles of the present invention.

FIG. 2 shows one embodiment of a voltage regulator 200 that meets the requirements set forth above, without using an NMOS pass transistor and/or large load capacitor. In the embodiment shown in FIG. 2, error amplifier 201 may receive a reference voltage input $V_{ref}$ 208, and may be coupled to resistors 230 and 232 and a load 236, in a manner similar to error amplifier 104 in FIG. 1, to generate regulated voltage output $V_{reg}$ 234. However, in regulator circuit 200, NMOS pass transistor 106 from voltage regulator circuit 100 has been replaced with PMOS pass transistor 228. The input stage of error amplifier 201 may be formed by PMOS transistors 210 and 214. A current mirror formed using PMOS devices 212 and 216 may be configured to mirror a bias current (generated off Vdd in the channel of PMOS device 216) to the input stage of error amplifier 210. The output stage of amplifier 201 may comprise a cascode stage (NMOS devices 222 and 226), coupled between NMOS devices 238 and 240, and a current mirror (PMOS devices 220 and 224). A bias current generated through the channel of PMOS device 220 may be mirrored in the channel of PMOS device 224. The output stage may generate the error signal provided at the control terminal (or gate) of PMOS pass device 228. A signal (voltage) based on $V_{reg}$ 234 and established between resistors 230 and 232 may be fed back to the input stage, more specifically to the control (gate) terminal of PMOS device 214, to create the feedback (control) loop. As seen in circuit 200, a capacitor $C_{CL}$ 206 may be coupled between Vdd and the respective control (gate) terminals of NMOS transistors 204, 221, 238 and 240, to increase current flowing through transistors 238 and 240 of the output stage of amplifier 201 during transients, or in general during rising edges of supply voltage Vdd.

Considering circuit 200 without capacitor 206, a large and quick (on the order of ns or even a few μs) power supply step (transient) may cause cascode transistors 222 and 226 to begin turning off during the rising edge of the transition period (of the supply step), as output signal $V_{reg}$ 234 begins to rise. Beyond a certain point, PMOS transistor 214 of the input stage of amplifier 201 may turn off, and the gate-drain capacitance of PMOS device 214 may begin to dominate, causing the voltage at the drain of PMOS transistor device 214 (and consequently, at the source of NMOS transistor device 222) to rise, and effectively turn off cascode transistors 222 and 226, causing regulated output $V_{reg}$ 234 no longer being controlled by the feedback loop, which may result in the regulated output $V_{reg}$ 234 rising to the supply voltage level Vdd.

In order to prevent the event described above, capacitor 206 may be coupled between power supply rail Vdd and the respective gate terminals of NMOS transistors 204, 221, 238, and 240 as shown. In order to obtain adequate frequency compensation, capacitor 207—having a value equivalent to the Miller capacitance associated with circuit 200—may also be coupled between regulated output $V_{reg}$ 234 and the low impedance node formed at the source terminal of NMOS device 226 and drain terminal of NMOS device 240 coupled together within the output stage of amplifier 201. It should be noted that circuit 200 may also include additional components configured to provide the bias voltage Vbnc for NMOS cascode device 218. Those skilled in the art will appreciate that a variety of different biasing circuits are possible, and any one of the many possible biasing circuits may be configured in circuit 200 to provide the required bias voltage to NMOS device 218.

Capacitor 206 coupled as shown in FIG. 2 may operate to cause an additional current flowing through transistors 238 and 240, (in other words, it may cause an increased current flow through NMOS devices 238 and 240), thereby causing the respective drains of transistors 238 and 240 to be pulled low during the rising edge of the supply voltage Vdd. This in turn may operate to prevent NMOS devices 222 and 226 from turning off, preventing output $V_{reg}$ 234 from rising during the rising edge of the supply voltage, thereby keeping $V_{reg}$ 234 from reaching the level of the supply voltage Vdd during transients and/or rising edges of Vdd. By preventing a drastic change on output $V_{reg}$ during a power supply transient and/or during other power supply variations (supply transition, for short), the control loop of power/voltage regulator 200 may remain functional during the supply transition. In other words, capacitor 206 configured as shown may cause increased current to flow through NMOS devices 238 and 240, keeping cascode NMOS transistors 222 and 226 turned on during the rising edge of the supply step to prevent output $V_{reg}$ from rising. During the falling edge of the supply step, NMOS devices 238 and 240 may turn off, resulting in no current flowing through NMOS devices 238 and 240 when there is a very sharp falling edge on supply voltage Vdd. It should also be noted that in embodiments where the power supply line (Vdd) is configured with a large capacitor (for example in certain automotive applications), the falling edge on the supply rail Vdd may be slow enough to avoid transistors 238 and 240 from turning off.

Various embodiments of regulator circuit presented in FIG. 2 may therefore provide improved power supply rejection for very large, fast steps on the voltage supply rail, without a need for any external components, and only requiring very few additional internal components (e.g. a 1 pF capacitor, such as capacitor 206 in power regulator circuit 200). In addition, circuit 200 may be implemented with a topology that includes a PMOS pass device (such as PMOS device 228 in FIG. 2), while still providing very good rejection of power supply variations. Finally, various embodiments may prevent loss of feedback control during large supply transients, as also explained above.

Figure 3:
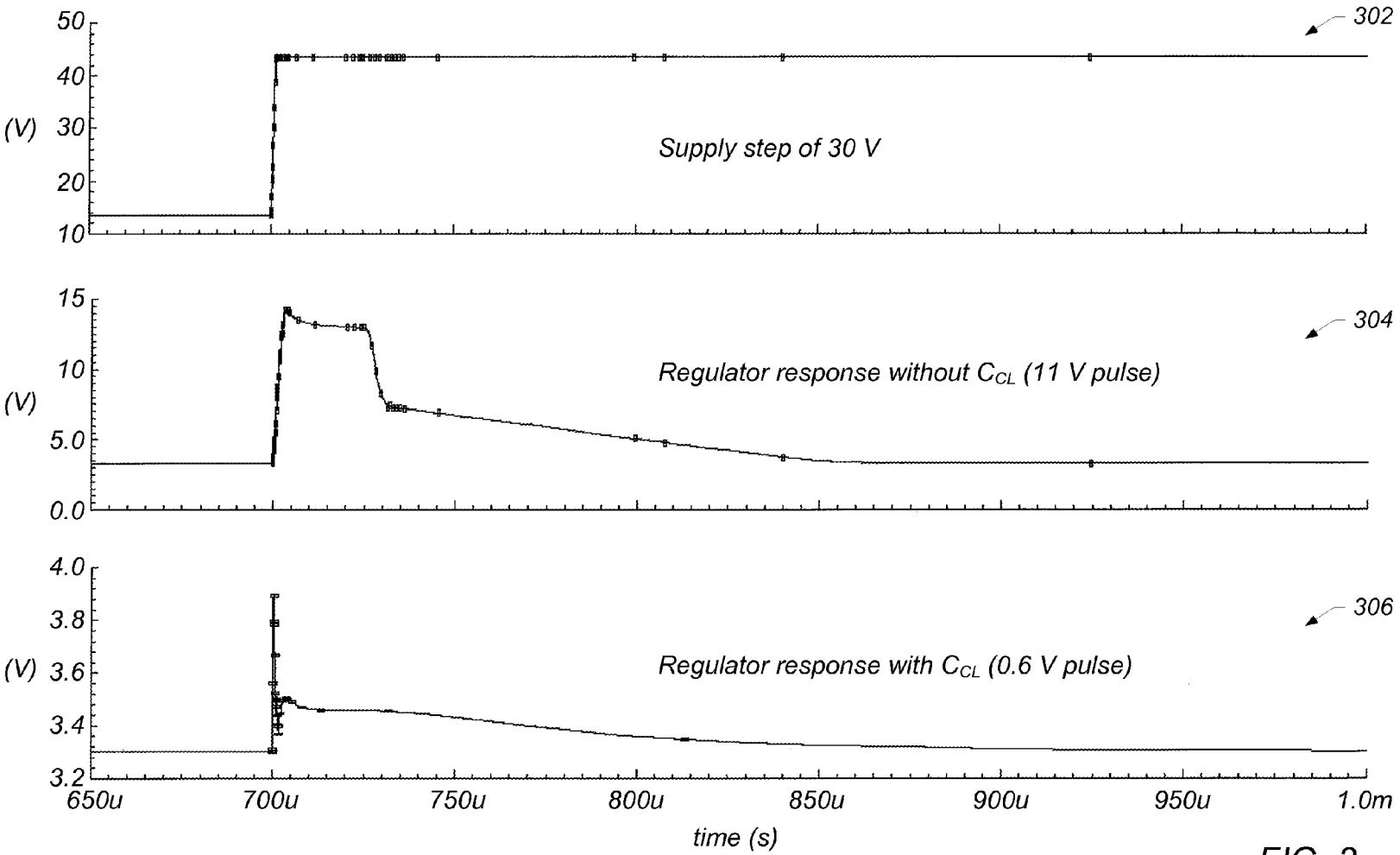
FIG. 3 is waveform diagram containing three voltage waveforms to illustrate the transient response of a power regulator to a step voltage of 30V magnitude.

FIG. 3 shows waveforms illustrating the transient response of (the output of) a power regulator, such as regulator 200, without capacitor 206 (waveform 304) and with capacitor 206 (waveform 306) for a supply step of 30V (waveform 302), provided as a simulation of a transient that may occur on the supply line (Vdd) during regular operation of power regulator 200. As seen in diagram 304, the response without capacitor 206 results in a voltage pulse of 11V in magnitude. In contrast, as seen in diagram 306, the response with capacitor 206 results in a voltage pulse of only 0.6V in magnitude.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

We claim:

1. An electronic circuit comprising:

an output node;

a first input transistor having: a first channel terminal configured to draw a first portion of a first current generated from a supply voltage; and a control terminal configured to receive a reference input;

a second input transistor having: a first channel terminal configured to draw a second portion of the first current; and a control terminal configured in a feedback loop with the output node;

a first output transistor having: a first channel terminal coupled to the output node and configured to draw a second current generated from the supply voltage; a second channel terminal coupled to a second channel terminal of the first input transistor; and a control terminal configured to receive a biasing signal;

a second output transistor having: a first channel terminal configured to draw a third current generated from the supply voltage; a second channel terminal coupled to a second channel terminal of the second input transistor; and a control terminal configured to receive the biasing signal;

a third output transistor having: a first channel terminal coupled to the second channel terminal of the first output transistor; a second channel terminal coupled to a reference voltage; and a control terminal coupled to a control node;

a fourth output transistor having: a first channel terminal coupled to the second channel terminal of the second output transistor; a second channel terminal coupled to the reference voltage; and a control terminal coupled to the control node; and a capacitor coupled between the supply voltage and the control node to prevent the first and second transistors from turning off during a rising edge of the supply voltage, to prevent an output voltage generated at the output node from rising during the rising edge of the supply voltage.

2. The electronic circuit of claim 1, further comprising a pass transistor having a control terminal coupled to the first channel terminal of the first output transistor; and a channel coupled between the supply voltage and the output node.

3. The electronic circuit of claim 2, wherein the pass transistor is a PMOS device.

4. The electronic circuit of claim 1, further comprising a voltage divider circuit, the voltage divider circuit comprising:

a first resistor coupled between the output node and the control terminal of the first input transistor; and a second resistor coupled between the control terminal of the first input transistor and the reference voltage.

5. The electronic circuit of claim 1, wherein the first and second input transistors are PMOS devices, and wherein the first, second, third, and fourth output transistors are NMOS devices.

6. The electronic circuit of claim 1, wherein the reference voltage is signal ground.

7. The electronic circuit of claim 1, further comprising a second capacitor coupled between the control node and the output node to achieve frequency compensation.

8. The electronic circuit of claim 1, further comprising:

a first current mirror circuit coupled to the supply voltage and configured to generate a bias current, wherein the first current is a mirrored current of the bias current; and a second current mirror circuit coupled to the supply voltage and configured to generate the second current, wherein the second current is a mirrored current of the third current.

9. A voltage regulator comprising:

a regulator output configured to provide a regulated voltage;

an error amplifier powered by a supply voltage, and having a first input configured to receive a reference signal;

a pass transistor having a control terminal coupled to an output of the error amplifier; wherein the channel of the pass transistor is coupled between the supply voltage and the regulator output;

wherein the regulator output is coupled to a second input of the error amplifier to form a feedback control loop;

wherein the error amplifier comprises an output stage configured to provide an output signal at the output of the error amplifier; and wherein the error amplifier is configured to control the output stage of the error amplifier to conduct current during a rising edge of the supply voltage to prevent the regulated output voltage from rising during the rising edge of the supply voltage.

10. The voltage regulator of claim 9, further comprising:

a first resistor coupled between the second input of the error amplifier and the regulator output; and a second resistor coupled between the regulator output and a voltage reference.

11. The voltage regulator of claim 9, wherein the error amplifier comprises:

a first input transistor having:

a first channel terminal configured to draw a first portion of a first current generated from the supply voltage; and a control terminal configured as the first input of the error amplifier; and a second input transistor having:

a first channel terminal configured to draw a second portion of the first current; and a control terminal configured as the second input of the error amplifier.

12. The voltage regulator of claim 11, wherein the output stage of the error amplifier comprises:

a first output transistor having:

a first channel terminal coupled to the regulator output and configured to draw a second current generated from the supply voltage;

a second channel terminal coupled to a second channel terminal of the first input transistor; and a control terminal configured to receive a biasing signal;

a second output transistor having:

a first channel terminal configured to draw a third current generated from the supply voltage;

a second channel terminal coupled to a second channel terminal of the second input transistor; and a control terminal configured to receive the biasing signal;

a third output transistor having:

a first channel terminal coupled to the second channel terminal of the first output transistor;

a second channel terminal coupled to a voltage reference; and a control terminal coupled to a control node; and a fourth output transistor having:

a first channel terminal coupled to the second channel terminal of the second output transistor;

a second channel terminal coupled to the voltage reference; and a control terminal coupled to the control node.

13. The voltage regulator of claim 12, further comprising a capacitor coupled between the control node and the regulator output achieve frequency compensation.

14. The voltage regulator of claim 12, further comprising a capacitor configured to effect additional current to flow through respective channels of the third and fourth output transistors, to prevent the first and second output transistors from turning off during a rising edge of the supply voltage.

15. A method for operating an electronic circuit, the method comprising:

providing a supply voltage to the electronic circuit;

providing a reference signal to the electronic circuit;

generating an output signal based on the supply voltage, the reference signal, and an error signal;

generating a feedback signal based on the output signal;

an output stage of the electronic circuit generating the error signal based on the supply voltage, the reference signal, and the feedback signal; and controlling the output stage from within the electronic circuit to have the output stage continue to conduct current during a rising edge of the supply voltage to prevent the output signal from rising to the level of the supply voltage during the rising edge of the supply voltage.

16. The method of claim 15, wherein said controlling comprises preventing a pair of cascode transistors configured in the output stage of the electronic circuit from turning off during the rising edge of the supply voltage.

17. The method of claim 16, wherein said preventing comprises causing an additional current to flow through a pair of output transistors having their respective channels coupled between respective channel terminals of the pair of cascode transistors and a voltage reference.

18. An electronic circuit comprising:

an input stage powered by a supply voltage and configured to receive a reference signal;

an output stage powered by the supply voltage and coupled to the input stage, and configured to generate an error signal based on: the reference signal, and a feedback signal based on an output signal;

a pass transistor powered by the supply voltage and configured to generate the output signal based on the error signal; and a capacitor coupled between the supply voltage and the output stage to increase current flowing in the output stage to have the output stage conduct current even during a rising edge of the supply voltage to prevent the output signal from reaching the level of the supply voltage during the rising edge of the supply voltage.

19. The electronic circuit of claim 18, wherein the input stage is a differential input stage comprising PMOS devices, and wherein the output stage is a cascode output stage comprising NMOS devices.

20. The electronic circuit of claim 18, wherein the pass transistor is a PMOS device.

* * * * *